US005121593A

United States Patent [19]

Forslund

[11] Patent Number: 5,121,593

[45] Date of Patent: Jun. 16, 1992

[54] DOOR MADE OF FOLDED SHEET METAL

[75] Inventor: Lars G. F. Forslund, Sollentuna, Sweden

[73] Assignee: Aktiebolaget Electrolux, Stockholm, Sweden

[21] Appl. No.: 645,208

[22] Filed: Jan. 24, 1991

[30] Foreign Application Priority Data

Mar. 14, 1990 [SE] Sweden ..... 9000906

[51] Int. Cl.[5] ..... F25D 23/02

[52] U.S. Cl. ..... 52/631; 52/782; 52/404

[58] Field of Search ..... 52/631, 782, 404

[56] References Cited

U.S. PATENT DOCUMENTS

| | | | |
|---|---|---|---|
| 1,846,881 | 2/1932 | Lewis | 52/631 |
| 2,485,643 | 10/1949 | Norquist | 52/631 |
| 3,731,449 | 5/1973 | Kephart, Jr. | 52/631 |

FOREIGN PATENT DOCUMENTS

| | | |
|---|---|---|
| 2907248 | 12/1981 | Fed. Rep. of Germany . |
| 3738952 | 5/1989 | Fed. Rep. of Germany . |
| B4268 | of 1908 | United Kingdom . |
| 2143020 | 1/1985 | United Kingdom . |

*Primary Examiner*—David A. Scherbel
*Assistant Examiner*—Joanne C. Downs
*Attorney, Agent, or Firm*—Pearne, Gordon, McCoy & Granger

[57] ABSTRACT

A door for a refrigerator or freezer shows a rectangular front part (12) with upwardly folded side parts (14), corner parts (15) being located between adjacent side parts (14) and connected with these in to the adjacent corner (13) of the front part (12. The front part (12) forms together with the side parts (14) and the corner parts (15) a completely tight tray which can be filled with plastic foam to a certain level above the front part (12) without the plastic foam being able to force its way out through the corners.

1 Claim, 3 Drawing Sheets

DOOR MADE OF FOLDED SHEET METAL

BACKGROUND OF THE INVENTION

1. Field of the Invention

The invention relates to a door for a refrigerator or freezer comprising an element folded from a pre-painted sheet blank, and having a rectangular front part with upwardly folded side parts, the front part forming the outside of the door.

2. Description of the Related Art

Such a door is known through GB-A-2,143,020. The known door does not need welding in the area of its corners K, which has the advantage that it can be made of a pre-painted sheet blank, the paint of which would be damaged if subjected to welding temperature.

The known door at the area at the corners K will not become quite tight if the door is insulated internally by an expanding and hardening plastic foam, but the foam will force its way out in the area of the corners K during the hardening. Furthermore, the known door shows exposed edges 7B at the corners K, which edges will get rusty in course of time, as the sheet blank is usually made of iron for refrigerators and freezers. Rust and remaining plastic foam at the corners K bring about the drawback that it is difficult to keep the door clean in this area.

SUMMARY OF THE INVENTION

These drawbacks are eliminated by the door according to the invention wherein the element shows corner parts which are located between and connected to adjacent side parts and are connected to the adjacent corner of the front part, the corner parts being folded inwards over the front part, so that the respective corner part forms a first and a second fold with the respective adjacent side part and shows a third fold over the front part, which three folds converge at the adjacent corner of the front part.

It shall be pointed out that the element included in the door according to the invention is known per se through DE-B2-29 07 248 showing a cover for protecting stacked iron plates against rust, DE-A-37 38 952 referring to a flower-box and GB-B-4246 A.D. 1907 referring to a receptacle. None of these publications give any information that the element would be folded of pre-painted sheet metal and be part of a door for a refrigerator or freezer with the resulting advantages that the element does not need to be further painted, and that one obtains a door with very smooth surfaces which are easy to keep clean.

BRIEF DESCRIPTION OF THE DRAWINGS

An embodiment of a door according to the invention is described below in connection with the attached drawings, in which.

DESCRIPTION OF THE PREFERRED EMBODIMENT

Figure 1:
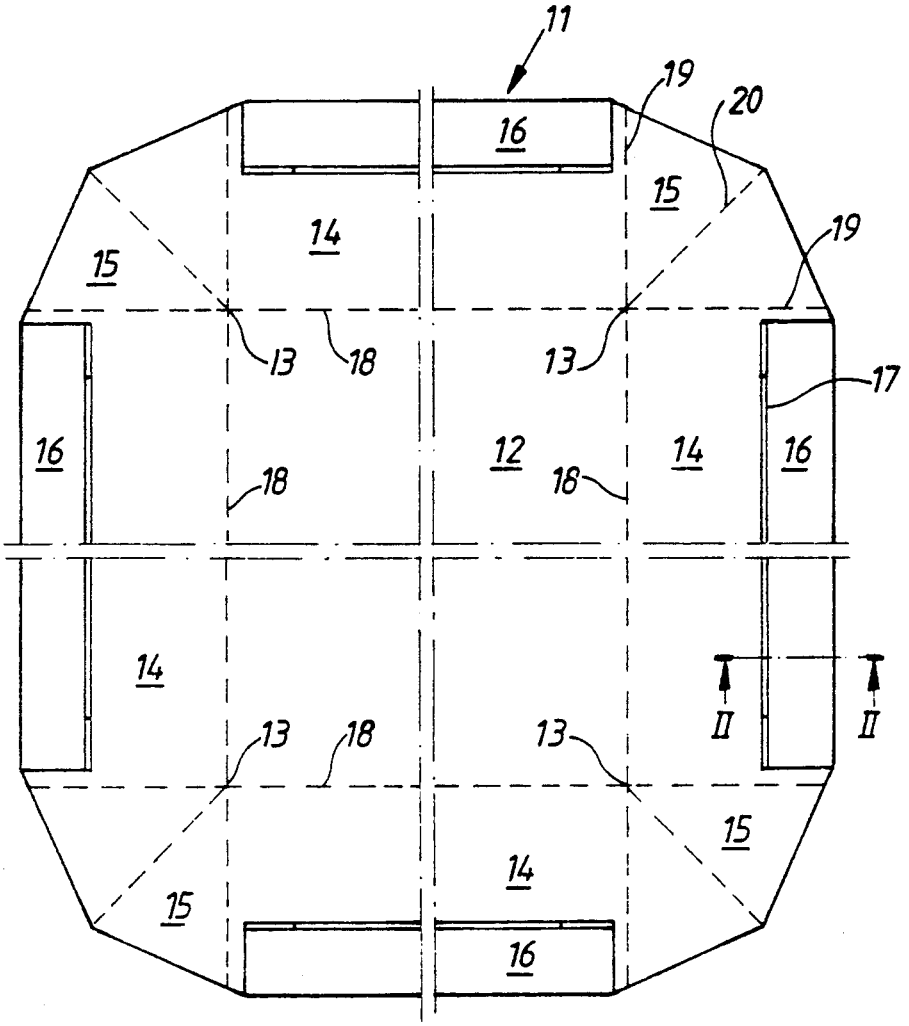
FIG. 1 shows a sheet blank.
Figure 2:
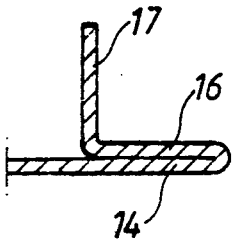
FIG. 2 shows a sectional view according to the marking II—II in FIG. 1.

In FIGS. 1 and 2 the numeral 11 designates a blank of pre-painted sheet iron showing a rectangular or square front part 12 with corners 13, four side parts 14 and four corner parts 15. The respective side part 14 at its outer edge folded 180° towards the blank with an edge part 16, from which a flange part 17 is folded upwards 90°.

Figure 3:
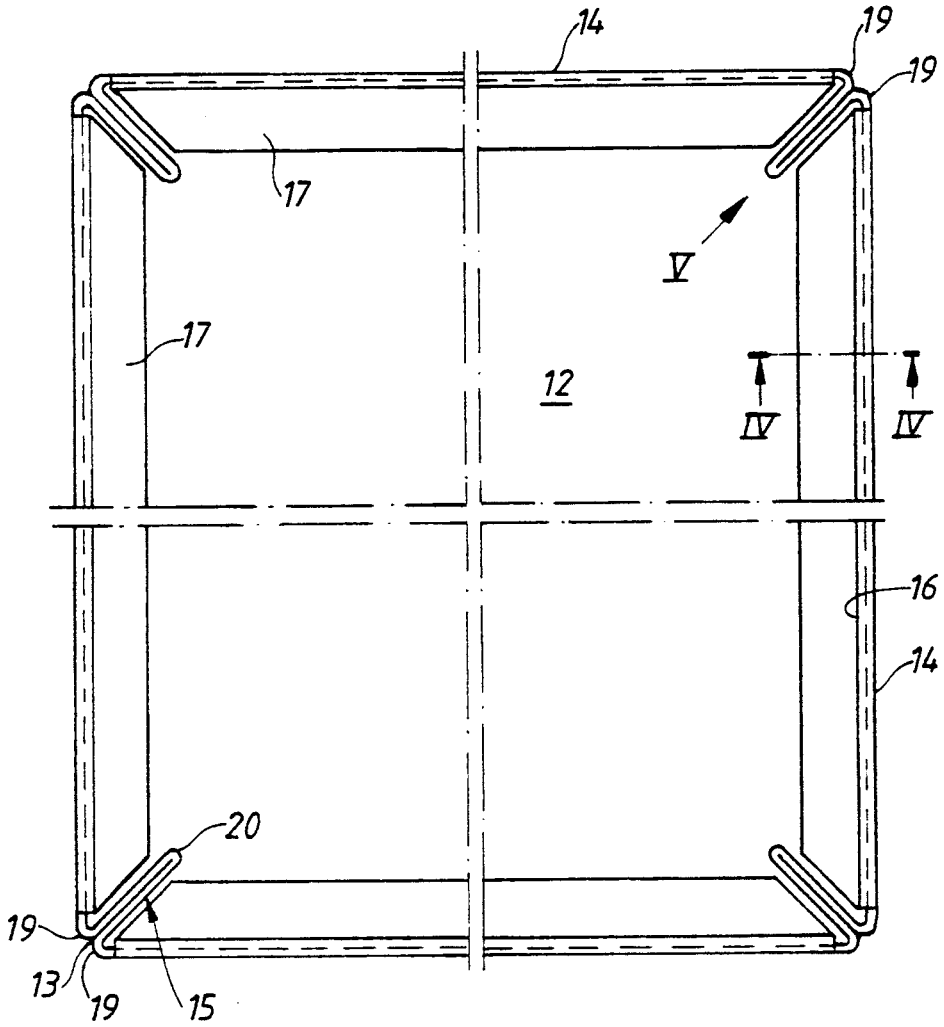
FIG. 3 shows how side parts and corner parts of the sheet blank have been folded so that they together with a front part form the door
Figure 4:
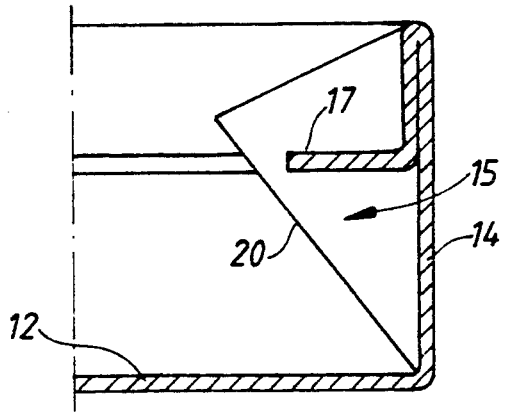
FIG. 4 shows a sectional view according to the marking IV—IV in FIG. 3.
Figure 5:
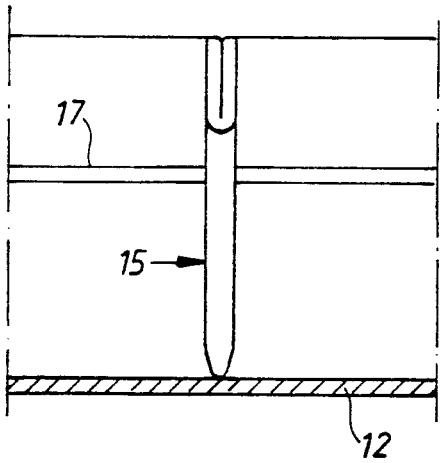
FIG. 5 shows a view according to the marking V in FIG. 3.

In FIG. 3 the side parts 14 have been folded upwards 90° about fold lines 18 and the corner parts 15 have been folded inwards over the front part 12 about fold lines 19 at adjacent side parts 14 and about a central fold line 20. The respective corner part 15 forms 45° angle with adjacent side parts 14.

Figure 6:
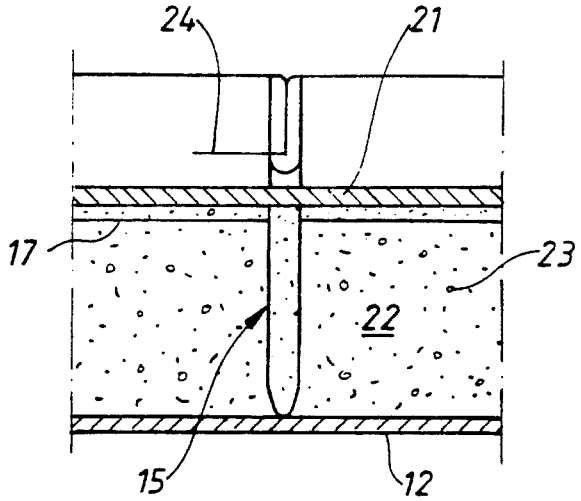
FIG. 6 shows the same view as FIG. 5 with the door filled with a foam-plastic insulation between an inner wall and the front part and FIG. 7 shows a perspective view of a corner part of the door.
Figure 7:
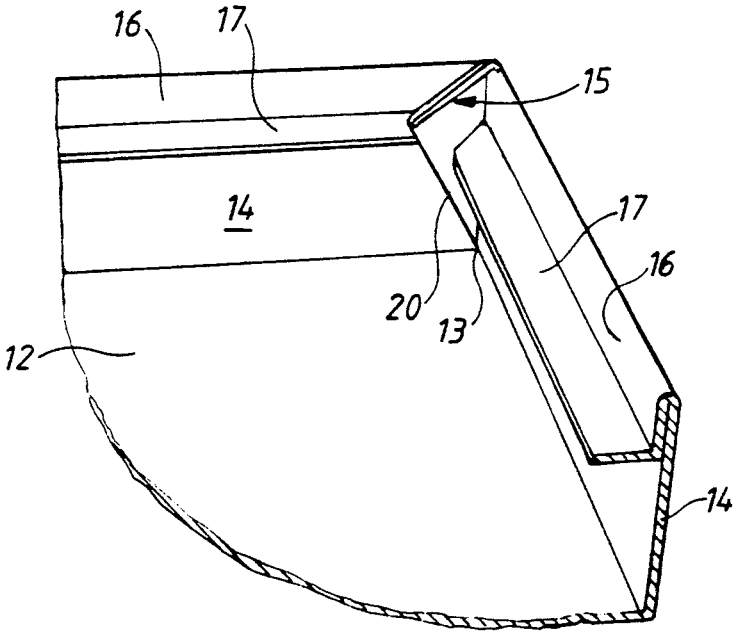

The door is intended for use in a refrigerator or freezer or as a lid of a chest freezer, a plastic sheet 21, see FIG. 6, forming the inside of the door being arranged substantially on the same level as the flange parts 17 and covering the space therebetween. The sheet 21 is fastened by an expanding and hardening plastic foam 23 filling up the space 22 between the sheet 21 and the front part 12. By the folds 19 and 20 being quite tight, the plastic foam 23 cannot force its way sideways out of the space 22 as long as it is located below a level 24, under which level the front part 12 together with the side parts 14 and the corner parts 15 form a completely tight tray.

The flange parts 17 are suitably used as a bonding surface for an endless refrigerator sealing extending around the periphery of the door, the corner parts 15 suitably being made such that they do not stick up above the flange parts 17.

I claim:

1. Door for a refrigerator or freezer comprising an element folded of a pre-painted sheet blank (11), which element shows a rectangular front part (12) with upwardly folded side parts (14), the front part forming the outside of the door, characterized in that the element shows corner parts (15), which are located between adjacent side parts (14) and are connected with these in to an adjacent corner (13) of the front part, the corner parts (15) being folded inwards over the front part (12), so that the respective corner part (15) forms a first and a second fold (19) with the respective adjacent side part (14) and forms a third fold (20) over the front part, which three folds (19, 19, 20) converge at the adjacent corner (13) of the front part (12), wherein the respective corner part (15) forms a 45° angle with adjacent side parts (14), wherein the respective side part (14) provides an inwardly directed first part (16) which is parallel with the side part, and a second part (17) which is directed inwardly from the first part and is parallel with the front part (12), said second part (17) defining a space (22) with said front part (12) therebetween, and wherein an expanding and hardening plastic foam fills up the space (22).

* * * * *